US006345580B1

(12) United States Patent
Klintworth

(10) Patent No.: US 6,345,580 B1
(45) Date of Patent: Feb. 12, 2002

(54) THRUST GRATE WITH LATERAL GUIDANCE MEMBERS FOR THE MOVED GRATE COMPONENT

(75) Inventor: Klaus Klintworth, Buxtehude (DE)

(73) Assignee: BMH Claudius Peters GmbH, Buxtehude (DE)

( * ) Notice: Subject to any disclaimer, the term of this patent is extended or adjusted under 35 U.S.C. 154(b) by 0 days.

(21) Appl. No.: 09/711,031

(22) Filed: Nov. 9, 2000

(30) Foreign Application Priority Data

Nov. 9, 1999 (EP) ..... 99 122 313

(51) Int. Cl.[7] ..... F23H 7/14
(52) U.S. Cl. ..... 110/268; 110/281; 432/137
(58) Field of Search ..... 110/268, 281, 110/282, 283, 284; 432/137; 198/750.1, 750.2

(56) References Cited

U.S. PATENT DOCUMENTS 3,358,385 A * 12/1967 Maberry ..... 34/164
3,802,553 A * 4/1974 Schrawder ..... 198/219
3,961,588 A * 6/1976 Bode et al. ..... 110/38
4,389,978 A * 6/1983 Northcote ..... 122/4 D
4,966,548 A * 10/1990 von Wedel ..... 432/77

FOREIGN PATENT DOCUMENTS

| | | | |
|---|---|---|---|
| DE | 762 599 | 3/1953 | |
| DE | 38 44 493 C1 | 8/1990 | |
| DE | 41 32 475 A1 | 4/1993 | |
| DE | 44 17 422 A1 | 11/1995 | |
| EP | 0 378 821 A2 | 12/1989 | |
| FR | 2463894 * | 4/1981 | ..... 110/281 |
| WO | WO 98/40683 | 9/1998 | |

OTHER PUBLICATIONS

European Search Report EP 99 12 2313.2 dated Jul. 14, 2000.

* cited by examiner

*Primary Examiner*—Denise L. Esquivel
*Assistant Examiner*—K B. Rinehart
(74) *Attorney, Agent, or Firm*—Alix, Yale & Ristas, LLP

(57) ABSTRACT

Thrust grate with a stationary grate component and with a grate component (2) moved forwards and backwards and is connected to members for its lateral guidance. These members are formed by oppositely arranged tension elements (3) stretched between the moved grate component (2) and a stationary structural part (1) essentially horizontally and perpendicularly to the direction of movement of the grate.

8 Claims, 1 Drawing Sheet

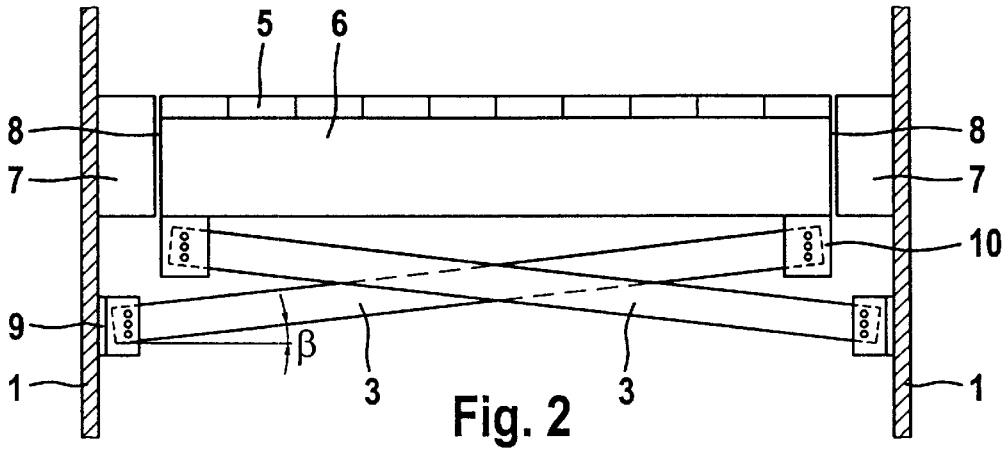
Fig. 2
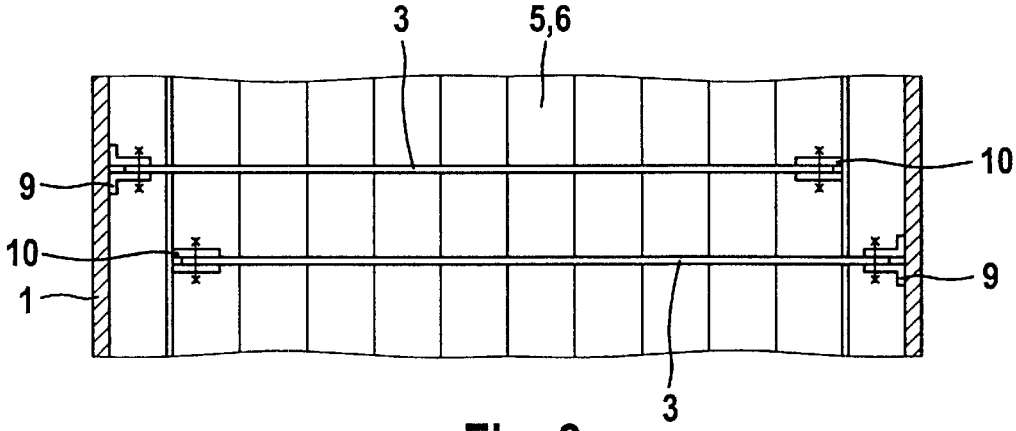
Fig. 3
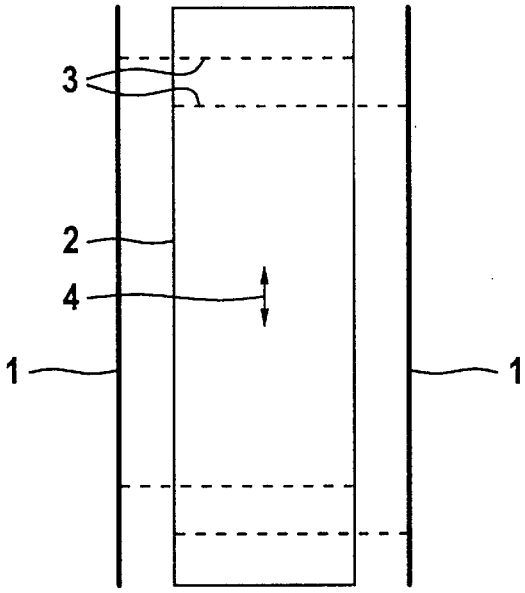
Fig. 1
Fig. 4
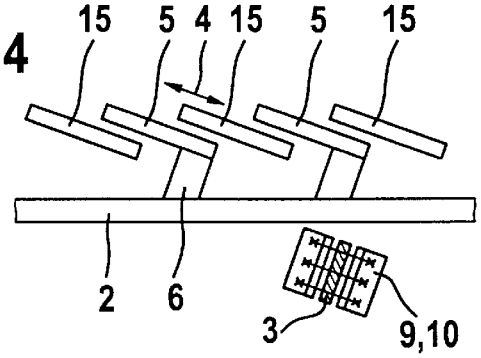
Fig. 5
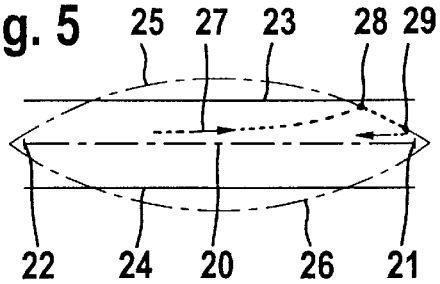

THRUST GRATE WITH LATERAL GUIDANCE MEMBERS FOR THE MOVED GRATE COMPONENT

BACKGROUND OF THE INVENTION

A thrust gate consists of transverse rows of grate plates, which transverse rows overlap one another in the manner of a roof tile and are arranged so as to be alternately stationary and moveable forwards and backwards in the longitudinal direction. The moveably arranged rows of grate plates are arranged in their entirety or in groups on frames which are carried by vertical guides and the correct lateral alignment of which is determined by lateral guides. Rollers on rails are conventionally used for vertical guidance, said rails being provided with cooperating track flanges or guide strips for the purpose of lateral guidance (EP-A-378 821, FIG. 1). It is also known (op. cit., FIG. 2), for vertical guidance, to use elongate tension elements, on which the moveable grate component is pendulously suspended. In this connection, the idea arose (op. cit., FIG. 3) of arranging the tension members obliquely in opposite directions, on the assumption that this could bring about lateral guidance, although this is obviously incorrect because such an arrangement does not rule out the possibility of lateral pendulous movement, but only modifies it. Separate lateral guidance members have therefore been retained hitherto, these being subject to wear, with the result that, on the one hand, lateral guidance quality diminishes in time and, on the other hand, complicated replacement becomes necessary from time to time.

SUMMARY OF THE INVENTION

The invention avoids these disadvantages by means of the features of Claim 1 and preferably those of the subclaims. Although the invention makes use, for lateral guidance, of members which are similar to those for pendulous grate suspension, the operative principle is nevertheless different. Whereas, in pendulous vertical guidance, a grate movement in the form of an arc of a circle necessarily takes place, lateral guidance must run in a straight line. The principle of pendulous guidance is therefore fundamentally unsuitable for lateral guidance. This also applies, in particular, when, according to the invention, horizontal pendulous guides are arranged in opposition on both sides, because the circular arcs of the pendulous guides located on both sides are not identical. The invention is based on the recognition that strict guidance is not necessary over the entire guidance distance and that it is sufficient if a defined lateral position is imparted to the grate in each case at individual points along the distance of its movement. If, for example, two opposing tension elements are arranged in such a way that they in each case stand perpendicularly to the direction of movement in the middle of the distance of movement of the grate and are tensioned exactly when the moved grate component reaches its reversal points, said tension elements thus ensure that the moved grate component has, at each of the reversal points, the desired lateral position, for example lies centrally with respect to lateral boundaries. In the case of non-extendible tension elements, guidance is restricted to the reversal points or to the adjacent region. There is theoretically no guidance in between. However, the laterally acting forces which could deflect the grate out of its central position are not so high that there would necessarily be the fear that said moved grate component would depart from its tolerance range before the next opportunity for correcting its position laterally, that is to say before the next reversal point is reached. In general terms, the tension elements are dimensioned in such a way that, in the event of a lateral deflection of the moved grate component up to the limit of its tolerance range, their tensile force is zero or insufficient in part of the distance of movement and only when one reversal point or the other is approached exceeds the amount which is necessary for a lateral correcting movement of the moveable grate component. If it is taken into account that the tension elements and those parts of the grate and of the stationary arrangement which are connected to them naturally have some elasticity, this situation can also be expressed in even more general terms, in that, in the event of a lateral deflection of the grate component up to the limit of its tolerance range, the difference in the tensile force of the tension elements in part of the distance of movement is lower than the resistance opposing a lateral displacement of the moved grate component, the difference in their tensile force exceeding this resistance only when a reversal point is approached. Admittedly, the invention also includes those versions in which the deliberate dimensioning of the elasticity and length of the tension elements has the result that, in the event of a lateral deflection of the moved grate component up to the tolerance limit, a difference in tensile force sufficient for lateral correction is produced at each point along the distance of movement. However, as stated, this is not required, because it is not necessary to reckon on a sudden lateral movement of the moveable grate component which guides the latter beyond the tolerance range.

If the difference in tensile force of the tension elements fall to zero in the middle region of the distance of movement, they theoretically become slack. This does not occur in practice, however, because, on the one hand, a complete disappearance of their lateral guidance force is unlikely on account of the elasticity inherent in them and the low height of the circular arc described by their ends and, on the other hand, the extent of any slackness is so slight that it is scarcely detectable.

It goes without saying that the tension elements should be long in relation to the longitudinal distance of movement of the moved grate component, so that their circular guidance arc becomes flat. It is sufficient, in general, if the tension elements in each case run from one lateral edge of the moved grate component to a structural part adjacent to the other lateral edge, that is to say, as a rule, over the entire width of the moved grate component.

So that the points of connection of the tension elements to the grate component and to the stationary structure are not subjected to any wear, they are expediently designed as flexural joints.

BRIEF DESCRIPTION OF THE DRAWINGS

The invention is explained in more detail below with reference to the drawing which illustrates an advantageous exemplary embodiment and in which:

FIG. 1 is a schematic, top plan view of a grate in accordance with the invention;

FIG. 2 is cross section view of the grate of FIG. 1;

FIG. 3 is a partial bottom view of the grate of FIG. 1;

FIG. 4 is a schematic view of an alternate embodiment of the grate of FIG. 1;

FIG. 5 is a diagram illustrating the movement of the tension members which is in the form of an arc of a circle.

DETAILED DESCRIPTION OF THE PREFERRED EMBODIMENT

FIG. 1 shows, between side walls 1, the frame 2 of a moveable grate component which is guided by two pairs of tension elements 3 during its movement back and forth in the direction of the arrow 4. Such a grate component has a width of several meters and a length of ten to twenty meters. Its distance of movement is of the order of 0.1 m. The permissible lateral deviation is in the range of a few millimeters. Unless described otherwise here, the grate may be designed conventionally and to that extent does not need any explanation, since it is known. It is sufficient to point out that the grate surface is formed by transverse rows of grate plates, said transverse rows being alternately stationary and moveable in the longitudinal direction.

FIG. 2 shows such a transverse row of moveable grate plates 5, which is carried by a crossmember 6 which may be carried in a way not illustrated by a frame 2. Provided between the ends of the row of moved grate plates 5 and the walls 1 are stationary grate plates or junction pieces 7 which, with the end of the moved row of grate plates, enclose a gap 8. The width of this gap will be as small as possible, in order to avoid an unnecessary loss of air and grate screenings. It is around a few millimeters. So that the moved grate components do not rub against the stationary lateral boundaries 7, which will lead to rapid destruction and a loss of energy, it is necessary for the moved grate component to have the guidance mentioned.

In the exemplary embodiment according to FIG. 2, the tension lines 3 which bring about the guidance of the moved grate component are formed by spring-steel bands, one end of which is anchored to the wall 1 or another fixed structure by means of a mounting 9, whilst the other end is anchored to the moved grate component by means of a mounting 10. The ends of the spring-steel bands 3 are expediently held rigidly in these mountings, their angular moveability being brought about not by relative movements in the mountings, but by the flexion of the spring-steel bands.

The use of spring-steel bands is particularly advantageous on account of their simplicity. Instead, inherently rigid parts may also be used, which are provided at the ends with flexural elements which, in turn, are anchored in the mountings. The rigid parts of the tension elements are, for example, rods, flat steel bars, tubes and the like. The flexible elements may be formed by spring-steel portions or wire-rope portions which in each case are connected, on the one hand, to the rigid parts and, on the other hand, to the mountings.

Chains may also be used as tension elements, but the disadvantage of this is that in each case the last chain links undergoing the stress of the articulation movement are subject to wear. Finally, there is also the possibility of the mountings having an inherently articulated design, which likewise has the disadvantage of wear and requires exchangeability and/or adjustability.

The tension elements 3 are expediently arranged approximately parallel to the transverse extent of the moveable grate component, that is to say essentially horizontally. Deviations from the horizontal direction may be caused by conditions of construction. Slight deviations from the horizontal direction generally do not disturb functioning. However, the angle $\beta$ should not exceed 20°. It is preferably below 15°, for example between 5° and 10°.

Expediently, in each case, two opposing tension elements are arranged so as to be closely adjacent to one another as a pair, since a large longitudinal spacing may lead to undesirable flexural stress on the moveable grate components.

If the tension elements are formed by leaf-shaped flexural elements or contain such elements, the plane of flexion (that is to say, the plane in which flexural movement takes place) of these elements should lie parallel to the direction of movement of the moved grate-plate component, as indicated in FIG. 4. This shows three stationary grate plates 15, which are supported by structural parts not illustrated, and grate plates 5 which are moved in each case between them and are carried by frame parts 2 via crossmembers 6. The direction of movement of the moved grate components runs parallel to the plane of extent of the moved grate plates 5, that is to say in the direction of the arrow 4. The mountings 9, 10 (indicated merely diagrammatically) for the leaf-shaped spring-steel bands 3 are therefore arranged obliquely in such a way that the leaf plane runs perpendicularly to the direction of the arrow 4.

The guiding action of the tension elements 3 is illustrated by means of the diagram in FIG. 5. It may be assumed that the moved grate component is guided in such a way that a point observed on the latter moves ideally along the dot-and-dash line 20 between the reversal points 21, 22. The lateral tolerance range of this movement is delimited by the lines 23, 24. There are tension elements, not shown, the end points of which describe circular arcs, illustrated in exaggerated form, which give the moved grate component freedom of movement within the range delimited by the circular arcs 25, 26. Over the greatest part of the distance of movement, these circular arcs lie outside the lines 23, 24 and would therefore theoretically allow the tolerance range to be exceeded. In practice, however, this does not happen. Should the point observed on the moved grate component approach the limit 23 of the tolerance range at point 28 towards the end of its stroke movement indicated by dashes, the tension element 3 would force said moved grate component, further along this movement, to assume the direction of the circular arc 25. It would reach the end of the stroke distance at point 29 which is near the ideal line 20. The observed point therefore commences the return stroke movement at a considerable distance from the tolerance limits. Whenever said moved grate component approaches these tolerance limits during a stroke, it is forced back again towards the middle at the end. In this case, the geometric conditions are selected such that the tendency of the grate to lateral drift is always lower than the possible lateral correcting distance at the end of the thrust and than the width of the tolerance range. Although the grate is not guided laterally over the greater part of the stroke distance, the lateral correction of position at the end of its the stroke distance ensures that it always remains within the lateral tolerance range.

The principle of movement according to FIG. 5 applies even when the tension elements are elastic. The circular arcs 25, 26 are then determined by that length of the tension elements at which the latter are extended such that their tensile force is equal to the lateral resistance force which is to be overcome during the correction of position of the plate. However, some force is already acting on the moved grate component in the correcting direction, even when the observed point has not yet reached the circular arc 25 or 26 in FIG. 5. Even if this correcting force may be lower than the force necessary for the lateral displacement of the grate, it can still at least partially compensate those forces which cause an undesirable lateral displacement of the moved grate component during the stroke movement, so that this undesirable lateral movement occurs to a lesser extent.

Practical tests showed that the invention makes it possible to have such a high lateral guidance quality that the width of the tolerance range for the lateral position of the moved grate component can be limited to fractions of a millimeter. This is of major importance to the efficient operation of a thrust grate.

Thermal expansion plays virtually no part in utilizing the invention, since, in the case of a thrust grate, irrespective of whether it is employed for cooling (for example, of cement clinker) or combustion (for example, refuse incineration), the temperature of the tension elements, of the associated stationary structural parts and of the grate substructure, on which the tension elements engage, is determined by the temperature of the air flowing to the grate from below.

What is claimed is:

1. Thrust grate comprising a stationary structural part, a stationary grate component, a moved grate component which is moveable forwards and backwards, and a plurality of guidance members connected to the moved grate component, the guidance members being formed by oppositely arranged tension elements tensioned between the moved grate component and the stationary structural part substantially horizontally and perpendicularly to the direction of movement of the grate, the tension elements being connected to the moved grate component and to the stationary structural part with flexural joints.

2. Thrust grate according to claim 1, wherein the tension elements exert a tensile force on the stationary structural part and the moved grate component, the tension elements, the stationary structural part, and the moved grate component each have an elasticity providing resistance opposing the lateral displacement of the moved grate component, the moved grate component has a lateral deflection tolerance range defining a distance of movement bounded by reversal points, and during lateral deflection of the moved grate component up to a limit of the tolerance range of the moved grate component, the difference in the tensile force of the tension elements in part of the distance of movement is lower than the resistance opposing the lateral displacement of the moved grate component and exceeds said resistance when a reversal point is approached.

3. Thrust grate according to claim 2, wherein during lateral deflection of the moved grate component up to the limit of the tolerance range of the moved grate component, the tensile force of the tension elements is zero in part of the distance of movement.

4. Thrust grate according to claim 1, wherein the moved grate component has oppositely disposed lateral edges and each of the tension elements run from one lateral edge of the moved grate component to a portion of the stationary structural part adjacent to the opposite lateral edge of the moved grate component.

5. Thrust grate comprising a stationary structural part, a stationary grate component, a moved grate component which is moveable forwards and backwards, and a plurality of guidance members connected to the moved grate component, the guidance members being formed by oppositely arranged tension elements tensioned between the moved grate component and the stationary structural part substantially horizontally and perpendicularly to the direction of movement of the grate, the tension elements being connected to either the moved grate component or to the stationary structural part with a flexural joint.

6. Thrust grate according to claim 5, wherein the tension elements exert a tensile force on the stationary structural part and the moved grate component, the tension elements, the stationary structural part, and the moved grate component each have an elasticity providing resistance opposing the lateral displacement of the moved grate component, the moved grate component has a lateral deflection tolerance range defining a distance of movement bounded by reversal points, and during lateral deflection of the moved grate component up to a limit of the tolerance range of the moved grate component, the difference in the tensile force of the tension elements in part of the distance of movement is lower than the resistance opposing the lateral displacement of the moved grate component and exceeds said resistance when a reversal point is approached.

7. Thrust grate according to claim 6, wherein during lateral deflection of the moved grate component up to the limit of the tolerance range of the moved grate component, the tensile force of the tension elements is zero in part of the distance of movement.

8. Thrust grate according to claim 5, wherein the moved grate component has oppositely disposed lateral edges and each of the tension elements run from one lateral edge of the moved grate component to a portion of the stationary structural part adjacent to the opposite lateral edge of the moved grate component.

* * * * *